United States Patent [19]

Massman

[11] 4,088,318

[45] May 9, 1978

[54] WRIST SUPPORT FOR ATHLETES

[76] Inventor: Reinhart T. Massman, P.O. Box 92, Paullina, Iowa 51046

[21] Appl. No.: 758,625

[22] Filed: Jan. 12, 1977

[51] Int. Cl.[2] ..... A63B 69/36

[52] U.S. Cl. ..... 273/54 B; 273/189 A

[58] Field of Search ..... 273/54 B, 189 A, 183 B; 84/468; 128/77, 88; 272/67; 2/161 A

[56] References Cited

U.S. PATENT DOCUMENTS

| | | | |
|---|---|---|---|
| 3,235,258 | 2/1966 | Stroburg | 273/54 B |
| 3,606,343 | 9/1971 | Lemon | 273/54 B |
| 3,790,168 | 2/1974 | Hashimoto | 273/54 B |
| 3,829,090 | 8/1974 | Ensinger | 273/54 B |

FOREIGN PATENT DOCUMENTS

| | | | |
|---|---|---|---|
| 484,025 | 6/1917 | France | 272/67 |
| 916,700 | 1/1963 | United Kingdom | 273/189 A |

*Primary Examiner*—Anton O. Oechsle

*Attorney, Agent, or Firm*—Henderson, Strom, Sturm, Cepican & Fix

[57] ABSTRACT

A wrist support for athletes is disclosed which prevents the wrist from "breaking" and insures proper follow through. The support device comprises a first rigid member adapted to engage the back of the hand, and a second rigid member adapted to be adjustably affixed to the forearm. The first and second members co-act through resilient biasing means which hold the first member in a rest position at between about 30° and about 45° to the second member.

10 Claims, 7 Drawing Figures

WRIST SUPPORT FOR ATHLETES

BACKGROUND OF THE INVENTION

This invention relates generally to wrist support devices, and specifically to wrist support devices for athletes which prevent the wrist from "breaking" and insure proper follow through.

There are numerous sports in which the athlete's performance is dependent upon his ability to prevent his wrist from "breaking", prevent his hand from twisting, and guarantee a consistently thorough follow through. For example, the most successful bowlers are those who can consistently control the positional relationship between their hand and forearm during delivery of the ball. Similar problems are encountered by golfers who must complete their golf swing without breaking their wrist while maintaining a complete follow through. The instant invention is directed to a wrist support device which is an aid to individual athletes endeavoring to perform well in the above-described, and similar, sports.

The known prior art devices are concerned primarily with the prevention of the "breaking" of the athletes wrist in a direction away from the palm of the hand. Many of these prior art devices engage the forearm and hand of the athlete with a brace extending across the top of the wrist. One such shows a device for supporting a bowlers wrist which includes an elongated strip of semi-rigid material strapped about both the bowlers hand and wrist on opposite sides of the wrist joint. The rest position of the hand while being engaged by the device is substantially in alignment with the forearm. The hand of the athlete is engaged by a strap which passes around the hand and across the palm. Another similar device includes a wrist band, finger support and a flat elastic member fixedly attached to the wrist support member and the finger support. The objective is to automatically lift the bowlers hand to increase the lift and spin on the bowling ball.

Each of the two devices described immediately above have inherent shortcomings which make them either impractical or unsatisfactory. Any device of this nature which has elements which extend across the palm of the hand or the fingers interfere with a comfortable and controlling grip on a bowling ball. Also, each of these devices has a tendency to move the hand into alignment with the wrist-a biasing which does not encourage the bowler to maintain or develop a proper follow through.

Another prior art device used to guide a bowler's hand affixes to the forearm of the user and includes a resilient bar or plate which extends across the wrist to engage a small portion of the back of the hand. The pressure with which the bar engages the back of the hand is adjustable to allow for personal comfort. While this device does not have elements which interfere with the grip on the ball, it does not prevent the hand from twisting, nor does it encourage maintenance or development of a successful follow through.

There are numerous other devices in this art. However, the majority of these devices merely maintain the wrist in a locked position, and are thus subject to the shortcomings of the previously described prior art.

BRIEF SUMMARY OF THE INVENTION

It is an object of this invention to provide a wrist support for athletes which overcomes the aforementioned problems of the prior art devices, and provides the necessary support for the wrist to keep it from "breaking", without interfering with the users ability to grip an object.

It is another object of this invention to provide a wrist support for athletes which insures the proper follow through.

It is another object of this invention to provide a wrist support for athletes which is durable of construction, inexpensive of manufacture, and extremely effective in use.

It is a further object of this invention to provide a wrist support for athletes which is shaped to fit snugly against the forearm and back of the hand of a user.

It is a further object of this invention to provide a wrist support for athletes which engages a large portion of the knuckle area of the back of the hand to prevent the hand from twisting.

It is a further object of this invention to provide a wrist support for athletes which is adjustable to fit numerous individuals with varying anatomical characteristics.

It is a still further object of this invention to provide a wrist support for athletes which urges the hand in a forward direction for better follow through during delivery of a bowling ball.

It is an even still further object of this invention to provide a wrist support for athletes which, in the rest position, maintains the hand at an angle of between about 30° and 45° with the forearm.

The foregoing objects and others are obtained according to the instant invention by providing a wrist support for athletes which prevents the wrist from "breaking" and insures proper follow through. The support device comprises a first rigid member adapted to engage the back of the hand and a second rigid member adapted to be adjustable affixed to the forearm. The first and second members co-act through resilient biasing means which hold the first member in a rest position at between about 30° and about 45° to the second member.

BRIEF DESCRIPTION OF THE DRAWINGS

For a better understanding of the invention as well as other objects and further features thereof, reference is made to the following detailed disclosure of the invention taken in conjunction with the accompanying drawings wherein.

DESCRIPTION OF THE PREFERRED EMBODIMENTS

Figure 1:
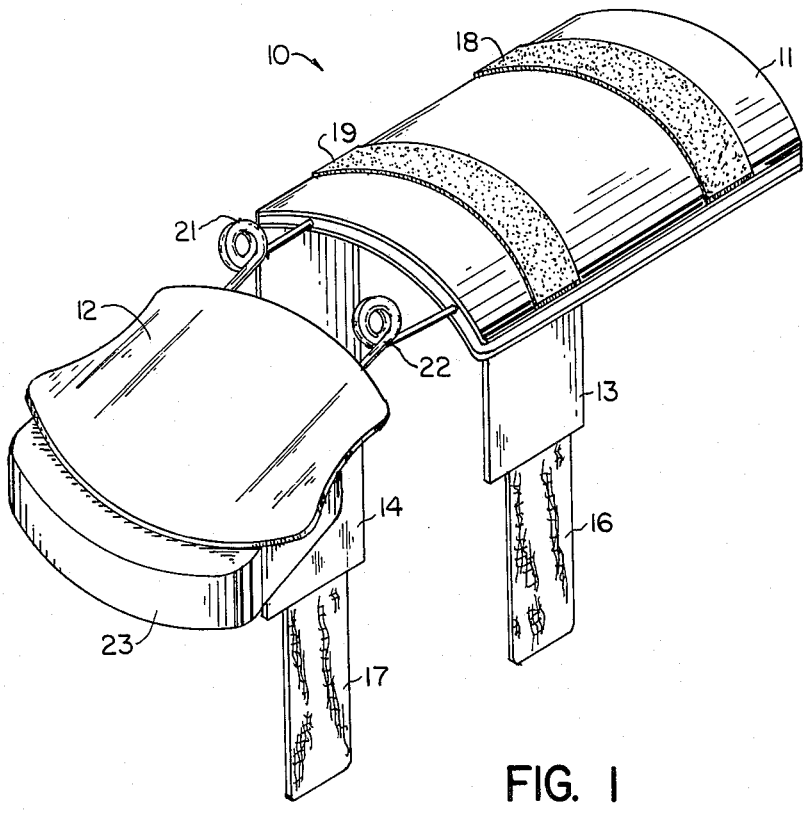
FIG. 1 is a partially schematic, perspective view of the wrist support device of the instant invention.

Referring now to FIG. 1, the wrist support 10 of the instant invention can be seen in perspective. The support device comprises two primary elements, a forearm engaging member 11 and a hand engaging member 12.

The two members 11 and 12 are held together by spring means 21 and 22 which are affixed at the ends thereof to each of the elements 11 and 12. Rigid member 11 includes a pair of straps, 13 and 14, affixed to one side thereof. Each of the straps include, on the ends thereof, Velcro hook strips 16 and 17 respectively. The top side of the rigid member 11 includes Velcro mats 18 and 19, which are fixedly and adjustable engagable with strips 16 and 17 on the two depending straps. Of course, any suitable fastening means may be employed. The member 12 is also rigid and shaped to fit the back of the user's hand across the knuckle area.

Figure 2:
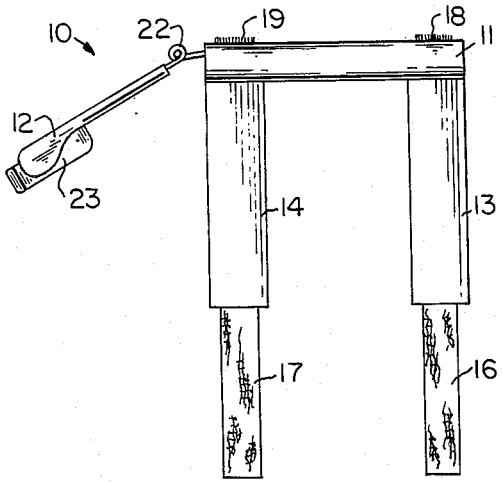
FIG. 2 is a side elevational view of the support device of FIG. 1.
Figure 6:
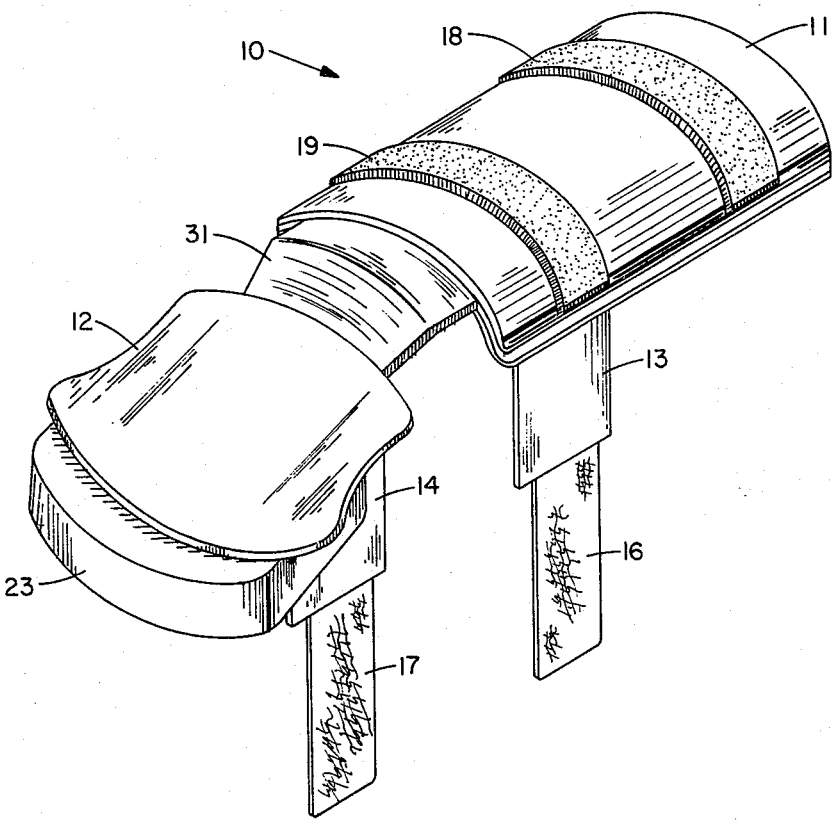
FIG. 6 is a side elevational view of a second embodiment.
Figure 7:
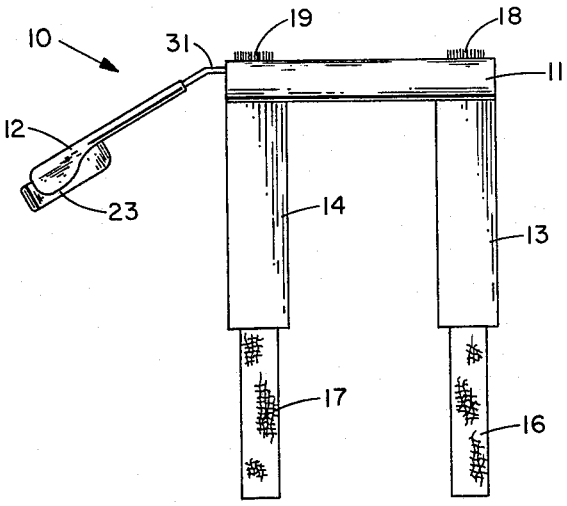
FIG. 7 is a partial detailed perspective view of the second embodiment shown in FIG. 6.

As can best be seen in FIG. 2, the positional relationship between the two members 11 and 12 is maintained by the biasing means 21 and 22. The hand engaging member 12 is maintained at an angle of preferably about 30°, but generally between about 30° and about 45° with the member 11. The spring means 21 and 22 may be replaced by any suitable biasing means. For example with reference to FIGS. 6 and 7, a piece of plastic having the proper resiliency characteristics and angle may be affixed at its ends to member 11 and 12, or the members may be made in an intregal manner to form a unitary body structure. This structure has the advantage of limiting any twisting between the rigid member 11 and the hand engaging member 12. Returning to FIG. 2, for comfort, a molded piece of foam or other suitable foam-like material 23 is affixed to the lower forward portion of member 12. The foam is positioned to engage the back of the hand in the knuckle area and, because of its resiliency, eliminates the abrasive action between member 12 and the hand.

Figure 3:
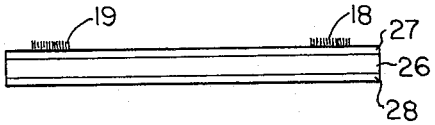
FIG. 3 is a cross sectional view of the member showing an exemplary construction thereof.

FIG. 3 shows a cross sectional view of the rigid member 11, but is should be noted that the hand engaging member 12 would also be constructed in a similar fashion. A rigid element 26 shaped to fit the forearm of the user forms the foundation for the device. Any suitable rigid material may be used for element 26, such as, for example, fiber glas, wood, metal, metal alloys or plastic. The rigid member 26 is sandwiched between two layers 27 and 28 which may comprise any suitable material which is pleasing to the eye and comfortable when in contact with the skin. Materials particularly suitable for layers 27 and 28 include, for example, nylon, cloth and vinyl. Layer 28 may optionally include a layer of foam or other padding to increase comfort. Alternatively, members 11 and 12 may, as stated above, comprise a unitary structure with no extra layers or thin layers of padding on the underside.

Figure 4:
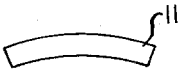
FIG. 4 is a rear elevational view of member 11 showing the curvature thereof.
Figure 5:
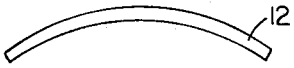
FIG. 5 is an end elevational view of member 12 showing the curvature thereof.

FIG. 4 shows an end view of the member 11 and is merely given to demonstrate the curvature of the member which is chosen to fit the forearm of the user. FIG. 5, likewise, is a partial end view of member 12 showing that its curvature is larger than that of member 11 to better fit the back of the hand.

With the support device fixed in place on the arm, the hand is gently biased, at rest, into substantially a 30° angle as shown in FIG. 2 The palm of the hand is free and unencumbered, and in a comfortable attitude to grip a ball. The weight of the ball and flexure of the muscles through the wrist cause the hand to push against the biasing means during the back swing and early delivery so that the angle between the forearm and hand decreases to a natural degree. As actual delivery takes place, the muscles relax as the weight of the ball diminishes, and the biasing means causes the hand to move through the natural arc known as follow through. The width of the element 12 is such that it supports substantially the entire knuckle area and back of the hand, and thus prevents twisting which would negate the effectiveness of the delivery.

It will be understood that various changes in the details, materials, steps and arrangements of parts, which have herein been described and illustrated in order to explain the nature of the invention, will occur to and may be made by those skilled in the art upon a reading of the disclosure within the principles and scope of the invention.

I claim:

1. A wrist support for athletes comprising:

(a) a first substantially rigid member adapted to engage substantially all of the knuckle area of the back of a user's hand;

(b) a second substantially rigid member adapted to be adjustably affixed to the forearm of a user and (c) resilient biasing means associated with said first and second members holding said first member in a rest position of between about 30° and about 45° to said second member, such that when said first substantially rigid member engages the back of a user's hand and said second substantially rigid member is affixed to the forearm of a user, said resilient biasing means maintains the back of the user's hand at an angle inward to the user's body of about 30° to 45° with respect to the forearm of the user, in the rest position.

2. The wrist support of claim 1 wherein said second member includes means thereon for affixing said second member to the forearm of a user.

3. The wrist support of claim 2 wherein said first member has a longitudinal axis of curvature whereby it may conform substantially to the back of a user's hand.

4. The wrist support of claim 3 wherein said second member has a longitudinal axis of curvature whereby it may conform substantially to the forearm of a user.

5. The wrist support of claim 4 wherein said first and second members include padding along the side thereof which would contact a user's hand and forearm.

6. The wrist support of claim 5 wherein said means for affixing said second member to the forearm of a user comprises at least two straps affixed to said second member, said straps and said second member having co-operating means thereon for adjustable affixment therebetween.

7. The wrist support of claim 6 wherein said resilient biasing means includes at least one spring affixed at opposing ends thereof to said first member and said second member, respectively.

8. The wrist support of claim 7 wherein said resilient biasing means comprises a pair of adjacent springs affixed at opposing ends thereof to said first and second members, respectively.

9. The wrist support of claim 6 wherein said biasing means comprises a resilient plastic bar having a first end extending into, and forming part of, said first member and a second end extending into, and forming part of, said second member.

10. The wrist support of claim 9 wherein said biasing means prevents substantial twisting between said first member and said second member.

* * * * *